US007600751B2

(12) United States Patent
Rozenfeld

(10) Patent No.: US 7,600,751 B2
(45) Date of Patent: Oct. 13, 2009

(54) APPARATUS FOR HANDLING MAILPIECES

(75) Inventor: Boris Rozenfeld, New Milford, CT (US)

(73) Assignee: Pitney Bowes Inc., Stamford, CT (US)

( * ) Notice: Subject to any disclaimer, the term of this patent is extended or adjusted under 35 U.S.C. 154(b) by 513 days.

(21) Appl. No.: 11/291,721

(22) Filed: Dec. 1, 2005

(65) Prior Publication Data

US 2007/0126173 A1 Jun. 7, 2007

(51) Int. Cl.
*B65H 31/04* (2006.01)
*B65H 31/30* (2006.01)

(52) U.S. Cl. ..... 271/214; 271/215; 271/217; 271/220; 414/790.3; 414/790.4

(58) Field of Classification Search ..... 271/207, 271/214, 215, 217, 220, 303; 414/788.9, 414/789.9, 790.3, 790.4, 790.9, 791.9, 792.7, 414/793.8

See application file for complete search history.

(56) References Cited

U.S. PATENT DOCUMENTS 3,832,938 A * 9/1974 Stapp et al. ..... 414/789.2
4,802,808 A * 2/1989 Wolk et al. ..... 414/789.2
5,273,516 A * 12/1993 Crowley ..... 493/416
5,347,790 A * 9/1994 Romanenko et al. ..... 53/443
5,803,704 A 9/1998 Lazzarotti ..... 414/793.4
6,501,041 B1 12/2002 Burns et al. ..... 209/584

* cited by examiner

*Primary Examiner*—David H Bollinger
(74) *Attorney, Agent, or Firm*—Brian A. Collins; Angelo N. Chaclas

(57) ABSTRACT

An apparatus for handling mailpieces produced by a mailpiece insertion system, comprising at least one mailpiece stacking assembly and a combination support/conveyor deck. The mailpiece stacking assembly accepts a plurality of mailpieces, i.e., as they are created by a mailpiece insertion system, and aligns the mailpieces to define a mailpiece stack. The support/conveyor deck is operative to convey mailpiece containers along a mailpiece handling path and includes loading and transport sections. The loading section is, furthermore, adapted to alternately reposition each of the mailpiece containers from an in-plane position to an out-of-plane position relative to the mailpiece handling path. The in-plane position is operative to transport the mailpiece containers along the mailpiece handling path while the out-of-plane position is operative to spatially reposition each of the mailpiece containers for alignment with a side edge of the mailpiece stack. That is, the loading section is capable of repositioning the mailpiece container such that its open end is proximal to and ready to receive the mailpiece stack. A loading mechanism is then employed to engage a side edge of the mailpiece stack for urging the stack into the open end of the mailpiece. That is, when the loading section has accurately repositioned the mailpiece container into alignment with the mailpiece stack, the loading mechanism may then displace and load the stack into the container.

17 Claims, 6 Drawing Sheets

APPARATUS FOR HANDLING MAILPIECES

TECHNICAL FIELD

The present invention relates generally to an apparatus for handling mailpieces and, more particularly, to a new and useful stacking, loading and transport apparatus adapted for use in combination with high-volume mailpiece inserters.

BACKGROUND OF THE INVENTION

A mail insertion system or a "mailpiece inserter" is commonly employed for producing mailpieces intended for mass mail communications. Such mailpiece inserters are typically used by organizations such as banks, insurance companies and utility companies for producing a large volume of specific mail communications where the contents of each mailpiece are directed to a particular addressee. Also, other organizations, such as direct mailers, use mailpiece inserters for producing mass mailings where the contents of each mailpiece are substantially identical with respect to each addressee.

In many respects, a typical inserter resembles a manufacturing assembly line. Sheets and other raw materials (i.e., a web of paper stock, enclosures, and envelopes) enter the inserter system as inputs. Various modules or workstations in the inserter system work cooperatively to process the sheets until a finished mail piece is produced. The precise configuration of each inserter system depends upon the needs of each customer or installation.

Typically, inserter systems prepare mall pieces by arranging preprinted sheets of material into a collation, i.e., the content material of the mail piece, on a transport deck. The collation of preprinted sheets may continue to a chassis module where additional sheets or inserts may be added based upon predefined criteria, e.g., an insert being sent to addressees in a particular geographic region. From the chassis module the fully developed collation may continue to a stitched module where the sheet material may be stitched, stapled or otherwise bound. Subsequently, the bound collation is typically folded and placed into envelopes. Once filled, the envelopes are closed, sealed, weighed, and sorted. A postage meter may then be used to apply postage indicia based upon the weight and/or size of the mail piece. The mailpieces will then be moved to a stacker where mailpieces are collected and stacked, either on edge or laid flat.

In a final step, the mailpieces are manually removed by an operator and placed into mail trays or other storage containers. Such manual collection and removal is pragmatic, reliable and fiscally advantageous when the time of mailpiece removal can be shared and/or absorbed within the overall labor requirements associated with managing/operating the mailpiece inserter system. That is, this task can be efficiently performed when sufficient idle time exists between various other operational tasks, e.g., removing out-sorted mailpieces, cleaning/removing paper dust from various optical readers/scanning devices, etc., to periodically or intermittently unload the mailpiece stacker.

Advances in the art of mailpiece inserters have vastly increased the total mailpiece volume and rate of mailpiece production. For example, the Advanced Productivity System (APS) inserter system produced by Pitney Bowes Inc., located in Stamford, Conn., USA, can produce as many as twenty-two thousand (22,000) mailpieces in one hour of operation. Accordingly, hundreds of mail trays, collectively weighing over 10,000 lbs, must be removed and transported each hour by a system operator. In fact, the volume of mailpieces produced is sufficiently large that several system operators may be required to concentrate on the single/sole task of mailpiece collection and removal. Aside from the time associated with this final unloading step, it will be appreciated that the collection, removal and transport of such large mailpiece quantities can be highly demanding in terms of the physical workload. It will also be recognized that such physical demands can lead to inconsistent or reduced mailpiece throughput if/when the workload requirements are not properly balanced with the high volume mailpiece output.

A need, therefore, exists for an apparatus for stacking mailpieces produced by high volume mailpiece inserters, which apparatus ensures consistent throughput, is fiscally advantageous and provides a viable alternative to manual mailpiece collection and removal.

SUMMARY OF THE INVENTION

An apparatus is provided for handling mailpieces produced by a mailpiece insertion system, comprising at least one mailpiece stacking assembly and a combined support/conveyor system. The mailpiece stacking assembly accepts a plurality of mailpieces, i.e., as they are created by a mailpiece insertion system, and aligns the mailpieces to define a mailpiece stack. The support/conveyor system is operative to convey mailpiece containers along a mailpiece handling path and includes transport and loading sections. The loading section is, furthermore, adapted to alternately reposition each of the mailpiece containers from an in-plane position to an out-of-plane position relative to the mailpiece handling path. When oriented in-plane, the support/conveyor system is operative to transport the mailpiece containers along the mailpiece handling path, e.g., a network/system of conveyor belts/tracks, to any desired location. When disposed in an out-of-plane position, the support/conveyor is operative to spatially reposition each of the mailpiece containers for alignment with a side edge of the mailpiece stack. That is, the loading section is capable of repositioning the mailpiece container such that its open end is proximal to and pre-positioned to receive the mailpiece stack. A loading mechanism is then employed to engage a side edge of the mailpiece stack to urge the stack into the open end of the mailpiece. That is, when the loading section has accurately repositioned the mailpiece container into alignment with the mailpiece stack, the loading mechanism may then displace and load the stack into the container.

DETAILED DESCRIPTION OF THE DRAWINGS

An apparatus for handling mailpieces is described in the context of a mailpiece inserter system. While the inventive stacking/loading apparatus is useful for handling mailpieces, and especially mailpieces fabricated by a high speed mailpiece inserter, it should be appreciated that the invention is equally applicable to other adaptations for handling/stacking mailpieces and/or loading sheet material used in the fabrication of mailpieces. Consequently, the invention should not be construed as being limited to stacking and loading finished mailpieces or to mailpieces produced by, or for use in combination with, a high speed inserter system. Furthermore, while the invention is described in the context of a dual component system having parallel mailpiece handling paths, it will be appreciated that, for cost and/or other considerations, the invention may employ a single mailpiece handling path. Accordingly, the appended claims embrace single or multiple mailpiece handling (i.e., stacking, loading and transporting) paths.

Figure 1:
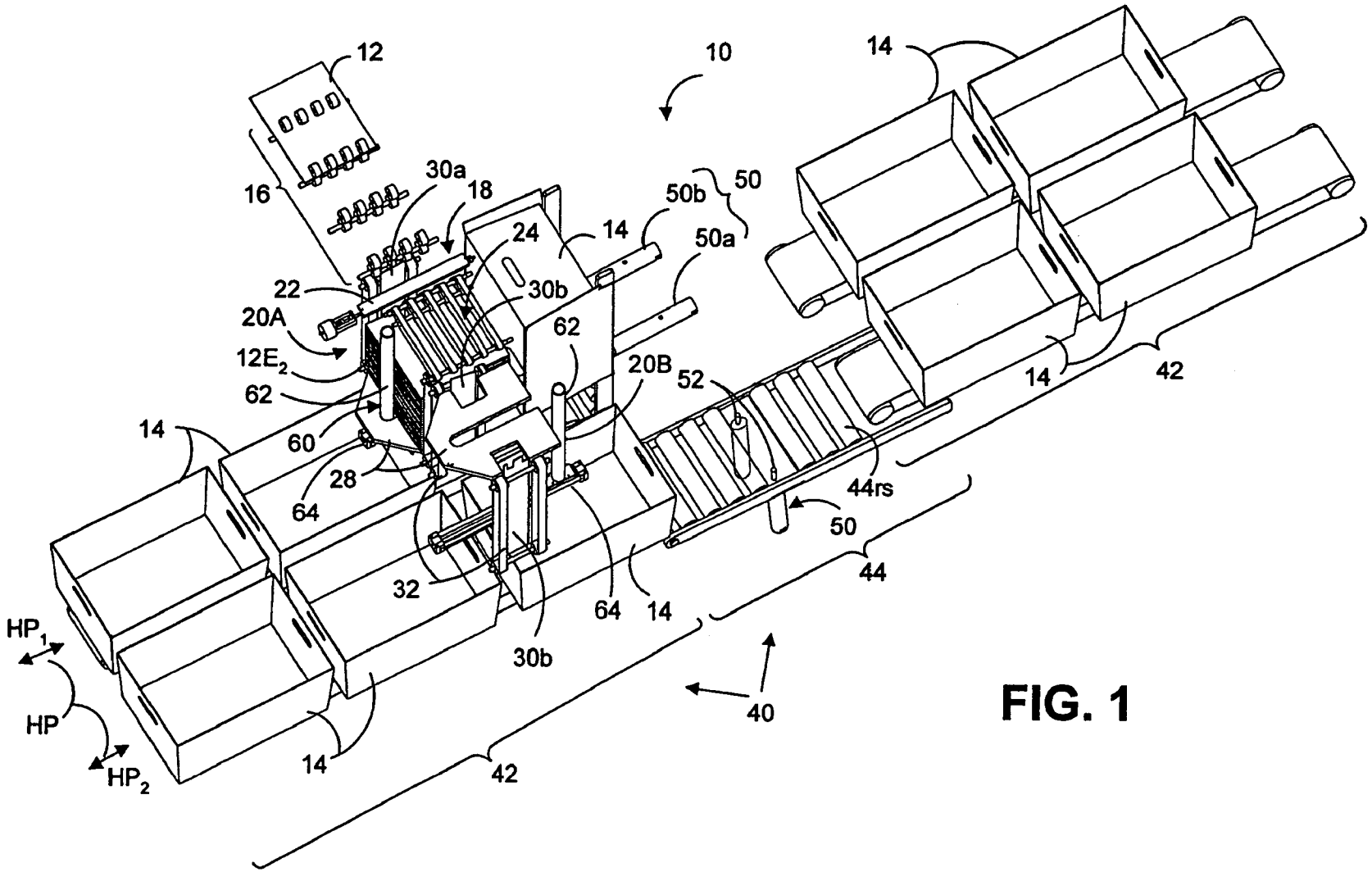
FIG. 1 is an isometric view of an apparatus for stacking/loading mailpieces in accordance with the teachings of the invention, the apparatus including a support platform adapted to accept and stack mailpieces produced by a mailpiece insertion system, and a loading/conveyor interface assembly to load/transport the mailpieces in mailpiece containers.

In FIG. 1, the inventive mailpiece handling apparatus 10 receives folded, sealed and/or finished mailpieces 12 from a high-speed/high volume mailpiece inserter (not shown). Inasmuch as a mailpiece inserter is typically described in terms of dedicated modules, the mailpiece handling apparatus 10 of the present invention may be viewed as one of the last, or final, modules of the mailpiece inserter. This module, therefore, is dedicated to stacking and loading mailpieces 12 into mailpiece containers, trays or bags 14.

Individual mailpieces 12 are conveyed via a serial arrangement of input rollers 16 which are mounted to and supported by a rigid structural frame (not shown to reveal the internal components and assemblies of the inventive mailpiece handling apparatus). The input rollers 16 direct the mailpieces 12 to a diverter assembly 18 which, in turn, directs the mailpieces 12 to one of two mailpiece stacking assemblies 20A, 20B.

Figure 2:
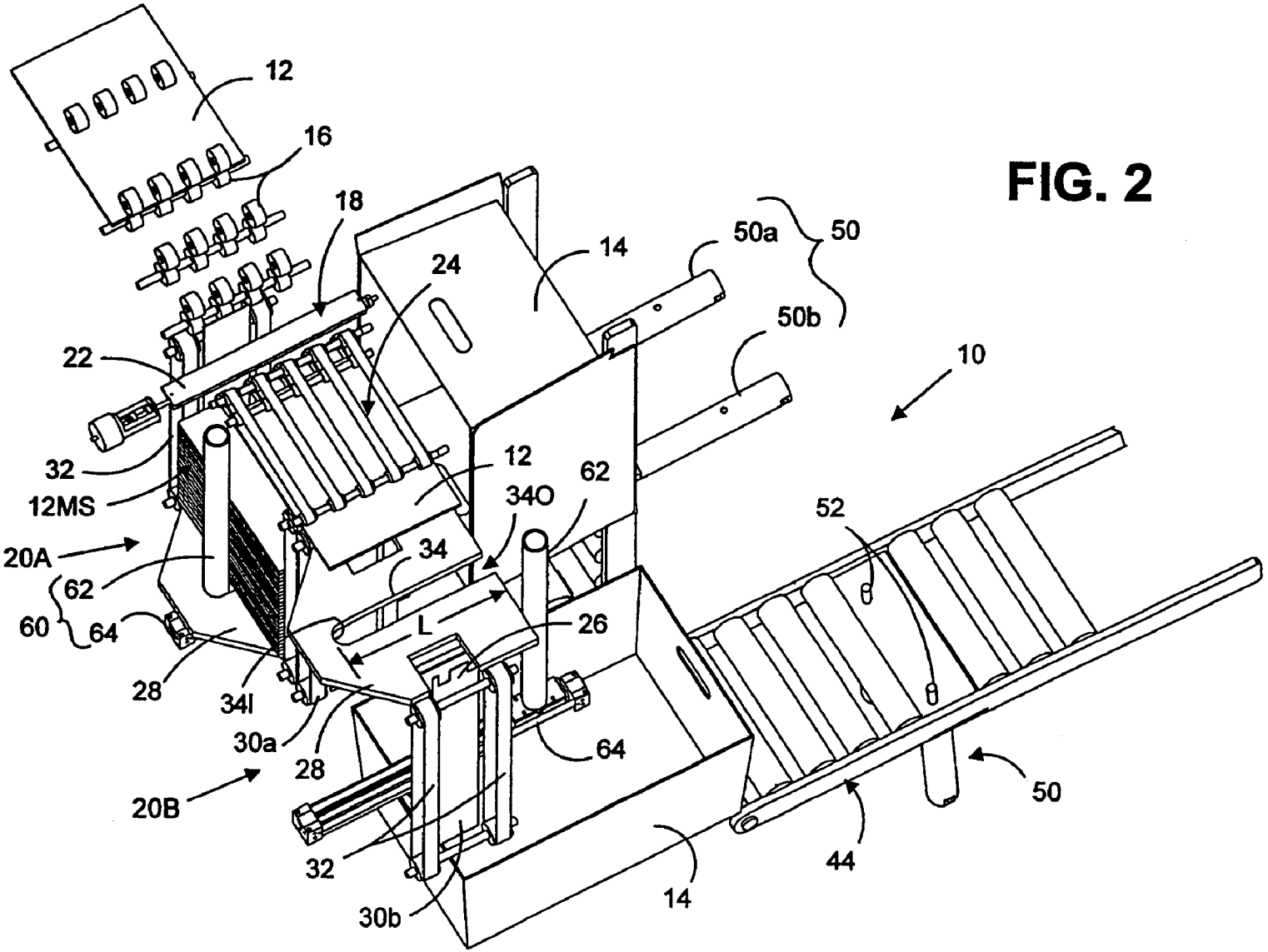
FIG. 2 is an enlarged view of a support platform assembly employed in the inventive stacking/loading apparatus.

In FIGS. 1 and 2, the diverter assembly 18 includes a flapper plate 22 which is moveable to deflect a mailpiece 12 in one of two directions. In one position, the flapper plate 22 directs the mailpieces 12 to the first mailpiece stacking assembly 20A while, in a second position, the plate 22 directs the mailpieces to a cross conveyor 24 which transport the mailpieces 24 across the first stacking assembly 20A to the second stacking assembly 20B. The cross conveyor 24 of the described embodiment is illustrated as a series of laterally spaced belts 24B which collectively span the distance between the stacking assemblies 20A, 20B, though a variety of mechanisms, e.g., a single belt or nip roller arrangement, may be employed to function in this capacity.

Upon passing the diverter assembly 18, a vertical finger or stop 26 (see FIG. 2) arrests the forward momentum of the mailpieces 12. As each mailpiece 12 is caused to abut the stop 26, mailpieces 12 begin to collect or stack vertically onto a movable support platform 28 of the stacking assemblies 20A, 20B. For ease of subsequent discussion, the invention will be described in the context of one of the stacking assemblies 20A or 20B and components downstream thereof. That is, inasmuch as the components of mailpiece handling apparatus 10 are symmetric from this point forward in the discussion, the description will be facilitated by making reference to one of the stacking assemblies 20A, 20B and respective mailpiece handling path, i.e., in contrast to discussing multiple paths simultaneously.

As mailpieces 12 collect on the support platform 28, vertical rails 30*a*, 30*b* guide the mailpieces 12 to form a mailpiece stack 12MS. More specifically, the mailpieces 12 are laid flat, stacked in register, and form a three dimensional polygonal shape having aligned sides 12S. In the described embodiment, the support platform 28 is coupled to elevator belts 32 disposed on one or more sides of the platform 28 to raise or lower the platform. As more mailpieces 12 are added, the support platform 28 is adapted to translate vertically thereby controlling the collection of mailpieces 12, i.e., without requiring mailpieces 12 to fall or drop as they are stacked.

Additionally, the support platform 28 is oversized with respect to at least one edge dimension of the mailpiece stack 12MS, e.g., the leading to trailing edge dimension L of the stack 12MS. Moreover, the support platform 28 includes a central elongate slot 34 extending the full length dimension L, which slot 34 is open at one end 340 thereof. The function of the slot 34 will be discussed in greater detail below, and at this juncture in the description, it is suffice to say that the slot 34 facilitates displacement and unloading of the mailpiece stack 12MS from the support platform 28.

Figure 3A:
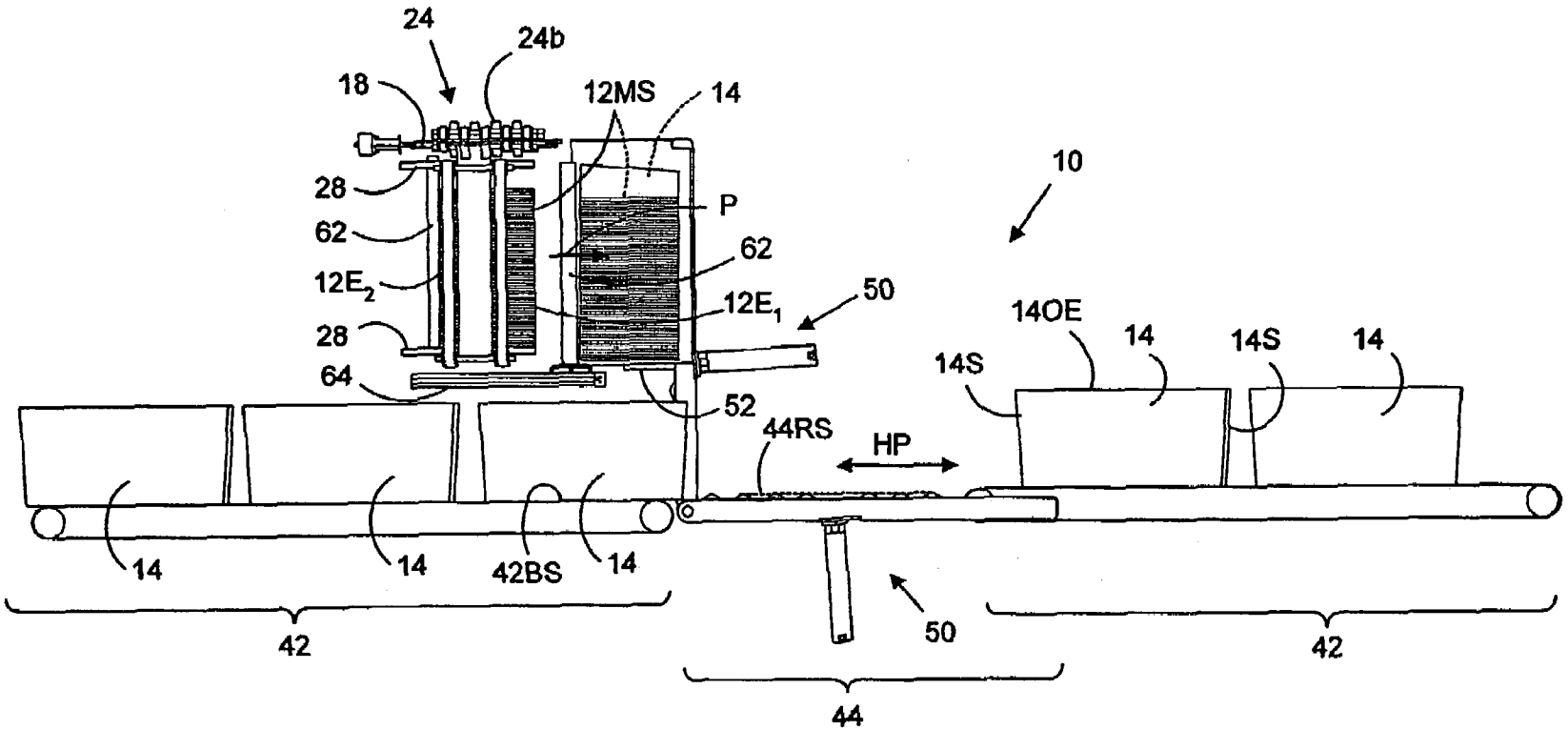
FIG. 3*a* is a top view of the inventive stacking loading apparatus shown in FIG. 1.
Figure 3B:
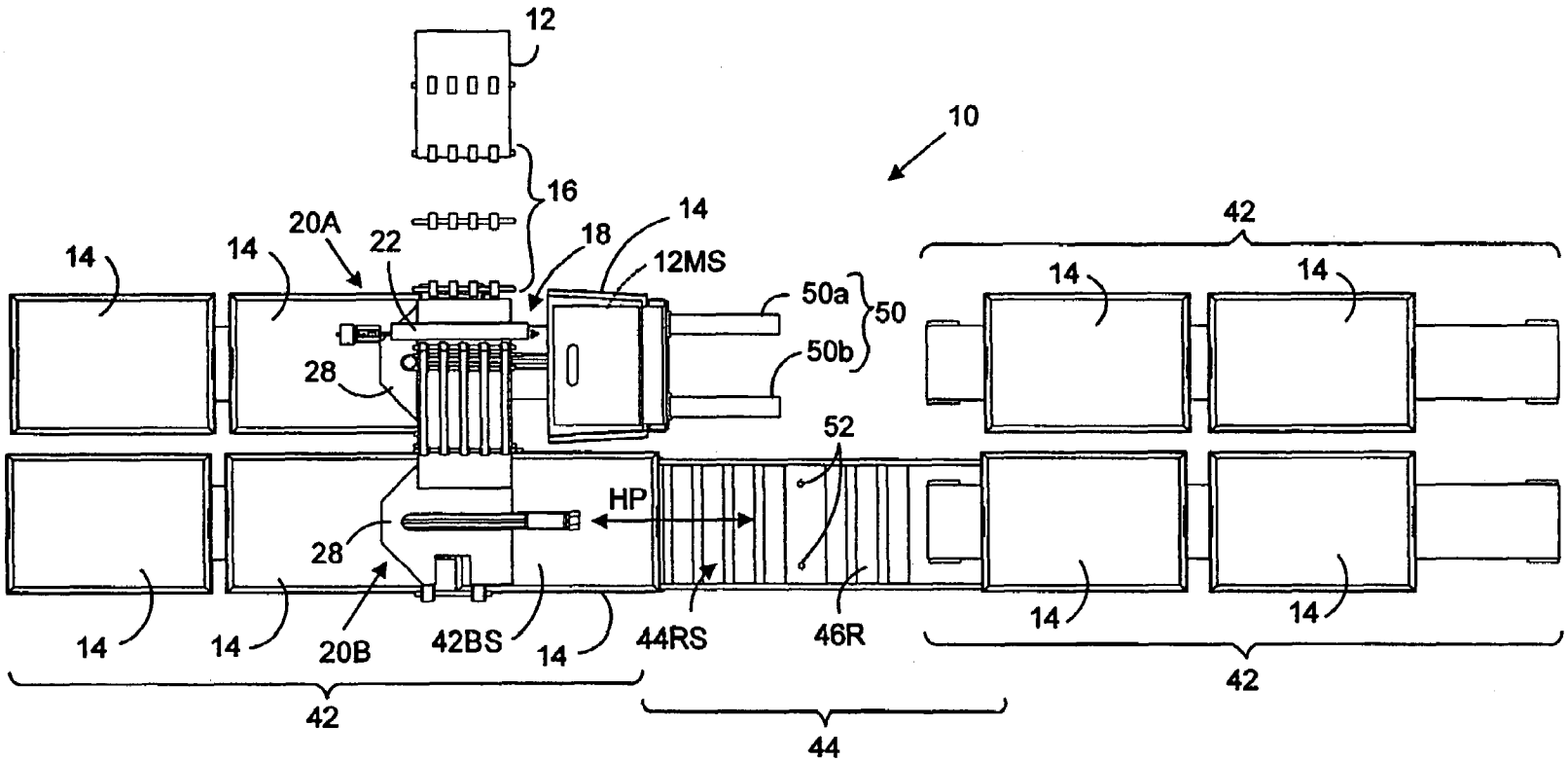
FIG. 3*b* is a side view of the inventive stacking/loading apparatus shown in FIG. 1.
Figure 4:
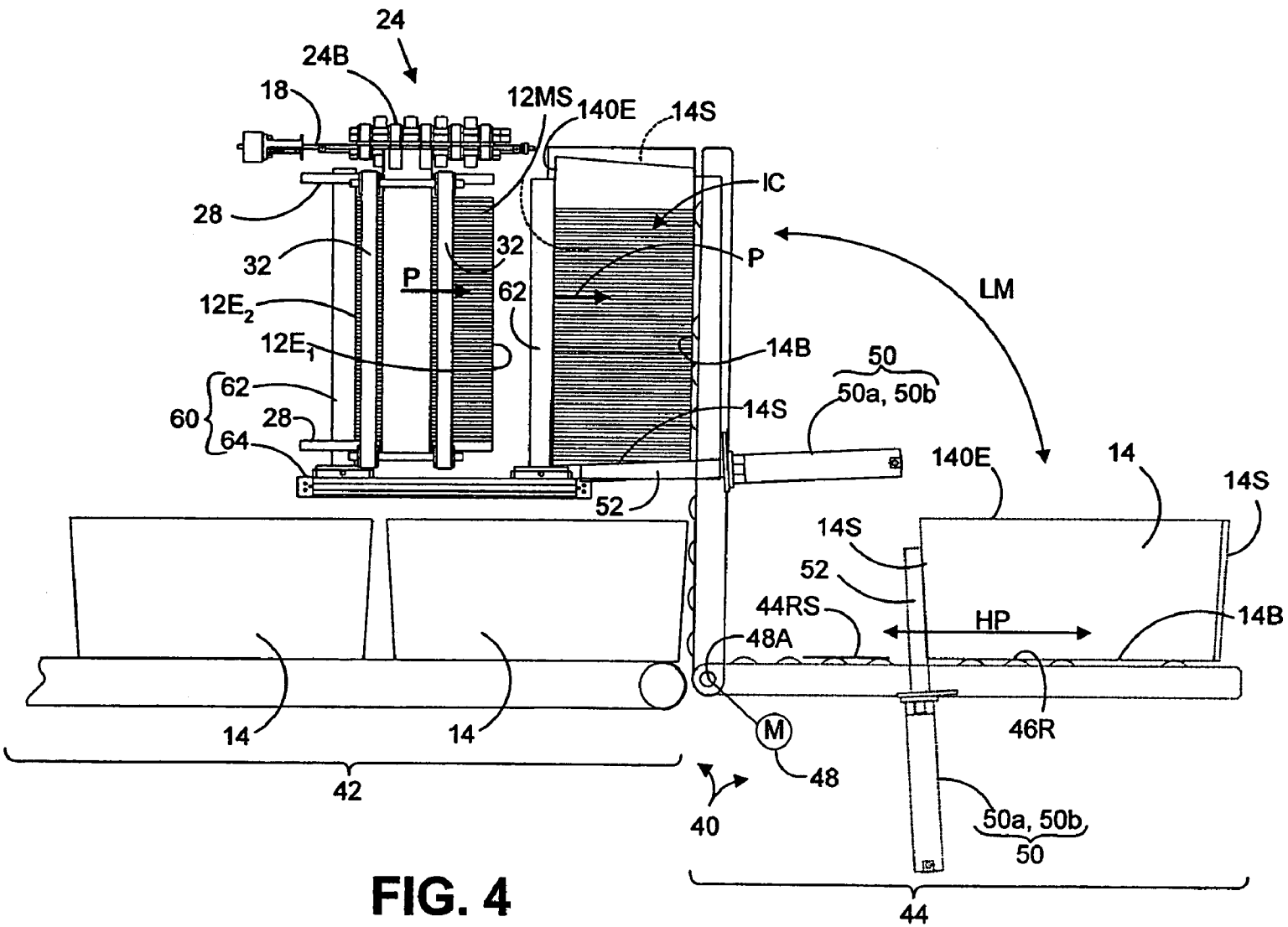
FIG. 4 is an enlarged side view depicting a support conveyor system for loading and transporting mailpieces into a plurality of mailpiece containers.

In FIGS. 1, 3 and 4, the mailpiece handling apparatus 10 also includes a support/conveyor system 40 operative to convey the mailpiece containers 14 along a mailpiece handling path HP and having transport and loading sections 42, 44. In broad functional terms, the loading section 44 is adapted to alternately reposition each of the mailpiece containers 14 from an in-plane position (shown in dashed lines in FIG. 4) to an out-of-plane position (shown in solid lines in all of the Figures) relative to the mailpiece handling path HP. While in its in-plane position, the loading section 44 is operative to transport the mailpiece containers along the mailpiece handling path. That is, the loading section 44 is aligned or coplanar with the transport section 42 to facilitate or enable transport of the containers 14 along the support decks 42BS, 44RS of the respective transport and loading sections 42, 44.

In the described embodiment, the transport section 42 includes a conveyor belt 42BS to structurally support and transport the mailpiece containers 14 while the loading section 44 includes a plurality of rollers 46R to define the support deck 44RS. It will be appreciated, therefore, that a variety of different structural elements, including, belts, chains, ropes, cables and straps etc., may be used to support and convey mailpiece containers 14 along the mailpiece handling path HP.

In the described embodiment, the loading section 44 is spatially repositioned by a high torque rotary actuator 48 for driving the support deck 44RS and mailpiece container 14 about a pivot or hinge axis 48A. Furthermore, the loading section 44 spatially repositions the container 14 such that the open end 140E of the container 14 is proximal to and aligned with a first side 12E1 of the mailpiece stack 12MS. Moreover, the loading section 44 is adapted to retain the position of the mailpiece container 14 while it traverses the arc LM necessary to position the mailpiece container 14 relative to the support platform 28 upon which the mailpiece stack 12MS rests.

More specifically, in FIGS. 1 and 4, the loading section 44 includes a support gate 50 having a retractable support/alignment member 52. The support/alignment member 52 may take any of a variety of forms including a plate, wall, arm, series of pins etc., capable of extending and retracting relative to the support deck 44RS. More specifically, the support gate 50 illustrated in FIG. 4, includes a pair of aligned pin cartridges 50*a*, 50*b* including retractable/extensible pins 52 which extend/retract orthogonally from the support deck 44RS. The pins 52 extend a sufficient length (i.e., from the surface of the support deck 44RS) and are separated a lateral distance suitable to support the weight of a fully loaded mailpiece container 14. In the described embodiment, the pins 52 abut and support one of the sides 14S of the mailpiece container 14, which sides 14S collectively define the internal cavity IC of the container 14. While the short side 14S is employed for supporting and rotating the mailpiece container 14, it will be appreciated that the loading section 44 may engage any of the container sides 14S including the base 14B of the mailpiece container 14.

In FIGS. 2 and 4, a mailpiece stack 12MS is urged into the internal cavity IC of the mailpiece container 14 by a loading mechanism 60. The loading mechanism 60 includes an elongate abutment rod or arm 62 extending through the central slot 34 of the support platform 28, a guide track 64 disposed beneath the support platform 28 for slideably mounting the abutment arm 62, and a linear actuator (not shown) for driving the abutment arm 62 linearly within the guide track 64. For clarity of illustration the guide track 64 and linear actuator are shown in perspective isolation, however, it will be appreciated that the track 64 and actuator may be affixed to any stationary support structure of the respective stacking assembly, or stationary frame support proximal to the respective support platform 28. Prior to loading and while the mailpieces 12 are being stacked, the abutment arm 62 is positioned at the innermost end portion, i.e., the closed end 341, of the platform slot 34. As mailpieces 12 are deposited on the support platform 28, the abutment arm 62 in combination with the guide rails 30*a*, 30*b* act to maintain alignment of the mailpiece stack 12MS as it builds in height or thickness. Once the respective stacking assembly 20A or 20B has received and aligned the mailpieces 12, i.e., completing the mailpiece stack 12MS, the abutment arm 62 is driven linearly along the guide track and within the elongate slot 34 of the support platform 28.

In operation, therefore, and referring to FIGS. 1 and 4, mailpieces 12 are fed to one of the stacking assemblies 20A or 20B by the diverter assembly 18. The support platform 28 or the respective stacking assembly 20A or 20B is lowered via the elevator belts 32 to build the vertical mailpiece stack 12MS. As mentioned in the preceding paragraph, the abutment arm 62 rests at the innermost end portion of the platform slot 34 and may, additionally, function to align an edge or side 12E2 of the mailpiece stack 12MS, i.e., in a manner functionally similar to the vertical guide rails 30*a*, 30*b*. Below the stacking assemblies 20A, 20B, the mailpiece containers 14 are, one-by-one, moved into position by the support/conveyor system 40. That is, loading section 44 is disposed in-plane with the transport section 42 to enable mailpiece containers 14 to be fully loaded on the loading section 44. In this container loading position, the pins 52 of the support gate 50 are extended above the plane of the loading support deck 44RS. Further, the pins 52 abut a side 14S of the mailpiece container 14 to position and support the mailpiece container 14 for subsequent rotation about the pivot or hinge axis 48A (see FIG. 4A).

FIG. 4 shows the mailpiece container 14 and support pins 52 in dashed lines as the mailpiece container is situated to be repositioned and loaded. The rotary actuator 48 is then activated to rotate the loading section 44, together with the empty mailpiece container 14, in a counterclockwise direction along an arc LM (shown as a bi-directional arrow in FIG. 4). The mailpiece container 14 then comes to rest at a position proximal to the mailpiece stack 12MS. With the open end 140E of the mail piece container 14 in alignment with the mailpiece stack 12MS, the loading mechanism 60 is activated to linearly drive the abutment arm 62 along the guide track 64 in the direction of arrow P. As such, the abutment arm 62 engages a side 12E2 of the mailpiece stack 12MS to urge the mailpiece stack 12MS into the cavity IC of the mailpiece container 14.

Upon loading a mailpiece stack 12MS within the cavity IC of one mailpiece container 14, the rotary actuator 48 reverses directions, once again along line LM, to effect clockwise rotation, of the loading section 44 about the pivot axis 48A. As the loading section 44 returns to an in-plane position, the empty support platform 28 of the respective stacking assembly 20A or 20B elevates upwardly to receive another mailpiece stack 12. Upon spatial repositioning of the loading section 44, i.e., returning to its in-plane position, the filled mailpiece container 14 may be transported along the mailpiece handling path HP. More specifically, the support gate 50 reverses direction to retract the support pins 52 beneath the plane of the support deck 44RS of the loading section 44. Consequently, the mailpiece container 44 is free to move along the support conveyor system 40, i.e., to move along the mailpiece handling path HP from the loading section 44 to the to the transport section 42.

In the illustrated embodiment, parallel paths are established for handling mailpieces, i.e., stacking, loading and transporting, in a plurality of mailpiece containers 14. For optimum efficiency, i.e., a level of efficiency required by high speed/high volume mailpiece inserters), a second mailpiece stack (not shown in the figures) may be initiated immediately following the completion of the first mailpiece stack 12MS. More specifically, mailpieces 12 may travel via the cross conveyor belts 24 from one stacking assembly 20A to the other stacking assembly 20B. As such, the production of a second mailpiece stack may begin even before a loaded mailpiece container 14 may have returned to an in-plane position for transport along the support/conveyor system 44. That is, in the time required for the loading mechanism 60 to load a mailpiece stack 12MS into a first mailpiece container 14 and reposition the same container 14 from its out-of-plane (vertical) position to an in-plane (or horizontal position), a second mailpiece stack 12MS may be prepared and ready for loading into a second mailpiece container 14. Consequently, a steady flow of loaded mailpiece containers 14 may be conveyed along one of two or more mailpiece handling paths.

Figure 5:
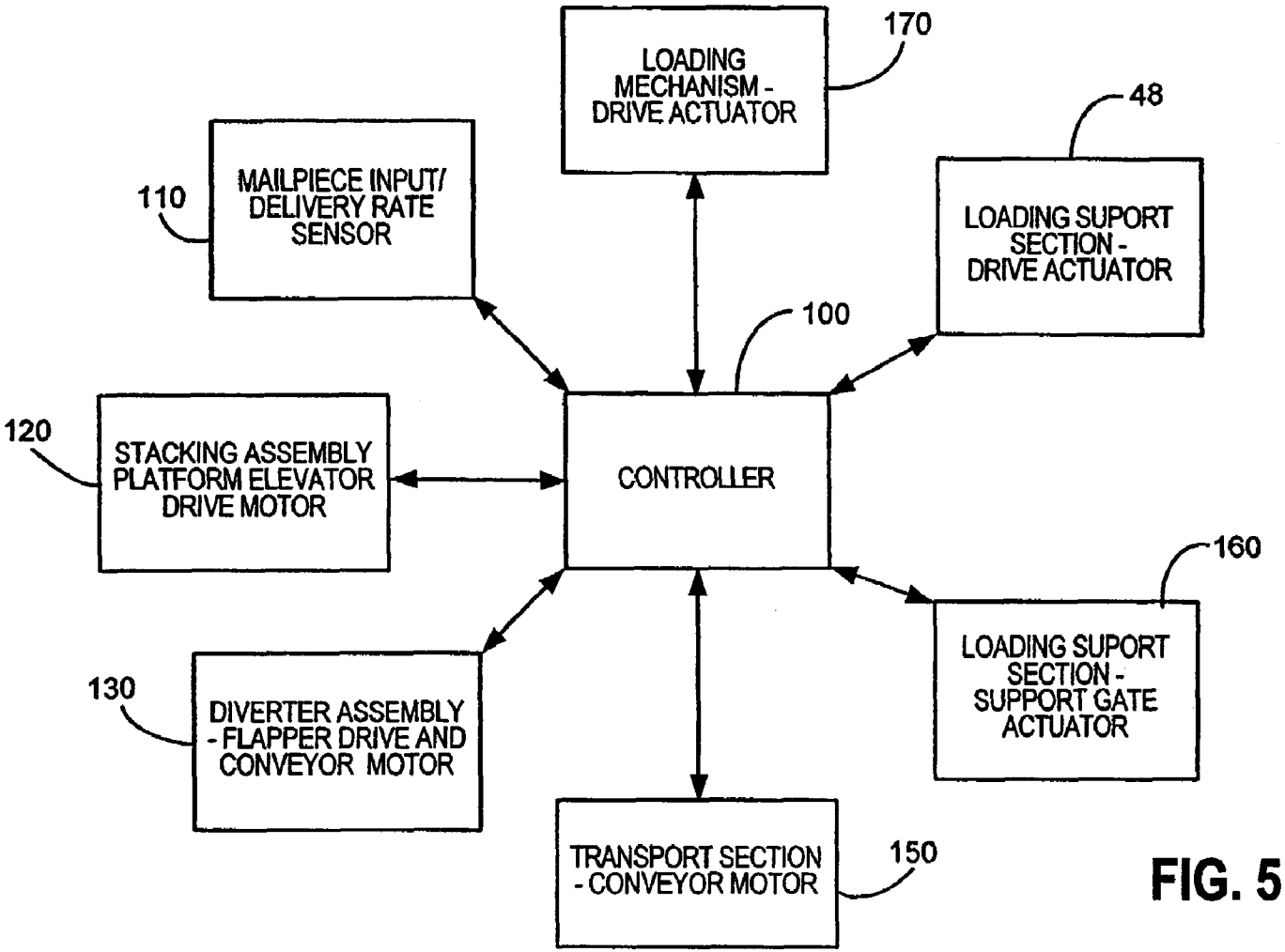
FIG. 5 is a schematic representation of the various elements/components which may be controlled/coordinated/synchronized by a central controller.

Depending upon the production rate of mailpieces fabricated and the rate of on-load/off-load of mailpiece containers 14 from the support/conveyor system 40, yet additional stacking assemblies 20A, 20B . . . 20N, (wherein N equals the number of mail piece handling paths HP) may be arranged and sequenced to operate in parallel. From a practical perspective, however, the number of handling paths will commonly be two, i.e., N=2. To highlight the cooperation of various system elements, FIG. 5 schematically shows the interaction of a central controller 100 with various drive motors/actuators which must be sequenced/synchronized/controlled to operate the mailpiece handling apparatus 10. Therein, the controller 100 controls or monitors the flow of mailpieces entering the stacking assemblies 20A, 20B via the speed of the input rollers 16. This may be measured/determined by a motion sensor 110 which employs optical signals to monitor the rate of mailpiece travel along the input roller path. Knowing the rate of mailpiece delivery and/or the anticipated thickness of each mailpiece 12 (assuming that an average mailpiece thickness is calculable and/or may be determined by mailpiece weight), the controller 100 may also determine the descent rate of the platform elevator, i.e., the motor 120 driving the elevator belts 32. If more than one stacking assembly 20 is employed the controller 100 may also control the diverter assembly 18, i.e., the flapper drive motor 130, to direct mailpieces 12 from one of the stacking assemblies 20A to another stacking assembly 20B.

In addition to controlling various elements of the stacking assemblies 20A, 20B, the controller 100 may also coordinate/synchronize the motion of the support/conveyor system 40. That is, the controller 100 can issue command signals to conveyor drive motors 150 of the transport section 42 to load/unload the mailpiece containers 14 to/from the loading section 44. Additionally, the controller may appropriately time the extension/retraction of the support gate 50 by sending/receiving command signals to each linear actuator 160 of the pin cartridges 50*a*, 50*b*. Finally, the controller 100 may synchronize the spatial orientation of the loading section 44 with the motion of the stacking assemblies 20A, 20*b*. That is, the rotary actuator 48 of the loading section may be commanded by the controller 100 to rotate upon completion, or near completion, of a mailpiece stack 12MS. As such, the mailpiece container 14 may be spatially positioned and/or properly oriented (vertically) at a time corresponding to the completion of the mailpiece stack 12MS.

With the mailpiece container 14 spatially positioned, the controller 100 may then command the linear actuator 170, i.e., the actuator driving the abutment arm 62 of the loading mechanism 60, to urge/load the mailpiece stack 12MS into the mailpiece container 14. Finally, the controller 100 will reverse the command signals to the various actuators 48, 160, 170, of the loading section 44, support gate 50 and loading mechanism 60, respectively, to unload the filled mailpiece container 14, and prepare the stacking assemblies 20A, 20*b* for subsequent filling/stacking operations. While FIG. 5 shows the various elements/components/systems being controlled by a central processor or controller 100, it will be appreciated that a plurality of individual controllers may be employed to perform the various control steps and achieve the same control motions. Such individual controllers may process such information discretely/independently or via parallel processing. Furthermore, while such elements/components may be controlled via closed-loop feedback system, it will be appreciated that these same elements may be preprogrammed to operate in a designated manner, in a predetermined sequence, or on a predefined schedule. Moreover, the mailpieces 12 which are stacked may be presorted such that when loaded within a mailpiece container the mailpieces are properly sequenced for delivery or arranged in an order consistent with a delivery route. The control algorithms for controlling the sequence of operation as described herein can be readily performed by a skilled artisan. Accordingly, no further detail is provided nor is necessary for practicing the teachings described herein.

In summary, the loading and transport apparatus of the present invention provides a system dedicated to stacking and loading mailpieces without human intervention. That is, the apparatus employs various features and components to (i) align mailpieces in register, (ii) compile a suitable number of mailpieces in the form of a mailpiece stack, (iii) displace or otherwise move the mailpiece stack from a support platform, (iv) place the mailpiece stack into a container without disturbing the mailpiece sequence/alignment, (v) arrange the mailpiece containers on a transport deck and (vi) convey the mailpiece containers to a desired location. All of the foregoing operations are performed without human intervention, hence the apparatus eliminates the potential for human injury including back, neck and or shoulder strain due to repetitive motion. Furthermore, in an alternate embodiment of the invention, the apparatus employs dual/parallel paths to further enhance or augment stacking/loading operations. That is, the apparatus is uniquely suited for use in combination with large, high-volume producing mailpiece insertion systems, i.e., systems capable of producing in excess of twenty-thousand mailpieces in each hour of operation. While one stacking assembly is being filled, the loading mechanism of the other stacking assembly loads the mailpiece stack into a mailpiece container. As such, mailpieces may be continuously fed without the requirement to pause or stop the production of mailpieces.

It is to be understood that the present invention is not to be considered as limited to the specific embodiments described above and shown in the accompanying drawings. The illustrations merely show the best mode presently contemplated for carrying out the invention, and which is susceptible to such changes as may be obvious to one skilled in the art. The invention is intended to cover all such variations, modifications and equivalents thereof as may be deemed to be within the scope of the claims appended hereto.

What is claimed is:

1. An apparatus for stacking mailpieces produced by a mailpiece inserter into a plurality of mailpiece containers, comprising:

a stacking assembly for accepting and aligning a plurality of mailpieces to define a mailpiece stack;

a support/conveyor system operative to convey the mailpiece containers along a mailpiece handling path and having transport and loading sections, the loading section adapted to alternately reposition each of the mailpiece containers from an in-plane position to an out-of-plane position relative to the mailpiece handling path, and a loading mechanism engaging a first side of the mailpiece stack to urge the mailpiece stack into an open end of the mailpiece container when spatially repositioned by the loading section of the support/conveyor system;

wherein the loading section is operative to transport the mailpiece containers along the mailpiece handling path when in an in-plane position, and is operative to spatially reposition each of the mailpiece containers such that the open end thereof is aligned with a second side of the mailpiece stack when in an out-of-plane position.

2. The apparatus according to claim 1 wherein the stacking assembly includes:

a platform for supporting mailpieces produced by the mailpiece inserter first and second guide rails adjacent the support platform and extending orthogonally relative thereto; and an elevator mechanism coupled to opposing sides of the support platform for raising and lowering the support platform relative to the guide rails;

whereby the support platform is lowered from a raised position as mailpieces are added to the support platform to develop the mailpiece stack.

3. The apparatus according to claim 2 wherein the support platform includes an elongate slot and wherein the loading mechanism includes:

a guide track disposed below the support platform and aligned with the elongate slot, an abutment arm slideably mounted within the guide track and extending through the elongate slot, the abutment arm furthermore extending orthogonally relative to the support platform and aligned with the first side of the mailpiece stack as mailpieces are added to the support platform, and a linear actuator for displacing the abutment arm within the guide track, whereby the abutment arm is operative to align the mailpiece stack along the first side and to engage the first side to urge the mailpiece stack into the open end of the mailpiece container.

4. The apparatus according to claim 2 wherein one of the guide rails includes a stop surface extending above the support platform to arrest the forward motion of each mailpiece.

5. The apparatus according to claim 1 wherein the loading section is mounted about a rotational axis and further includes a rotary actuator for alternately pivoting the loading section about the rotational axis from an in-plane to an out-of-plane spatial position.

6. The apparatus according to claim 4 wherein the loading section further comprises a support gate positionable from an extended position to a retracted position relative to a deck of the loading section; and wherein, in the extended position, the support gate is operative to engage a side of the mailpiece container to support the mailpiece container when the loading section alternately pivots from its in-plane position to its out-of-plane position and, in the retracted position, the support gate is operative to permit unobstructed movement of the mailpiece container along the mailpiece handling path.

7. The apparatus according to claim 5 wherein the support gate comprises a pair of pin cartridges each having a retractable/extensible pin, each pin cartridge having a linear actuator for extending and retracting the pin relative to the deck of the loading section.

8. The apparatus according to claim 1 further comprising a central controller for controlling the motion of the support/conveyor system and the loading mechanism to off-load mailpieces from the stacking assembly when the mailpiece container is positioned proximal to the second side of the mailpiece stack.

9. An apparatus for stacking mailpieces produced by a mailpiece inserter into mailpiece containers, comprising:

juxtaposed stacking assemblies for accepting and aligning a plurality of mailpieces, each stacking assembly forming a mailpiece stack;

a support/conveyor system combined with each of the stacking assemblies, the support/conveyor system operative to transport the mailpiece containers along one two mailpiece handling paths; the support conveyor system, furthermore being operative to spatially position mailpiece containers proximal to a side of the respective mailpiece stack, a diverter assembly for diverting mailpieces from one of the juxtaposed stacking assembly to the other stacking assembly when one of the stacking assemblies is filled; and a loading mechanism coupled to each of the stacking assemblies for urging the respective mailpiece stacks into an open end of each of the mailpiece containers when spatially positioned by the respective support/conveyor system.

10. The apparatus according to claim 9 wherein the diverter assembly further comprises:

a cross conveyor operative to convey mailpieces across one of the stacking assemblies to the other of the stacking assemblies a flap mounting about a rotational axis and operative to divert mailpieces to one of the stacking assemblies in one operating mode and operative to divert mailpieces to the cross conveyor in a second operating mode, and a rotary actuator operative to pivot the flap about the rotational axis to control the orientation of the flap in the first and second operating modes.

11. The apparatus according to claim 9 wherein each of the stacking assemblies include:

a platform for supporting mailpieces produced by the mailpiece inserter;

first and second guide rails adjacent the support platform and extending orthogonally relative thereto; and an elevator mechanism coupled to opposing sides of the support platform for raising and lowering the support platform relative to the guide rails;

whereby the support platform is lowered from a raised position as mailpieces are added to the support platform to develop the mailpiece stack.

12. The apparatus according to claim 11 wherein each of the support platforms include an elongate slot and wherein each of the loading mechanisms includes:

a guide track disposed below the support platform and aligned with the elongate slot, an abutment arm slideably mounted within the guide track and extending through the elongate slot, the abutment arm furthermore extending orthogonally relative to the support platform and aligned with the first side of the mailpiece stack as mailpieces are added to the support platform, and a linear actuator for displacing the abutment arm within the guide track, whereby the abutment arm is operative to align the mailpiece stack along the first side and to engage the first side to urge the mailpiece stack into the open end of the mailpiece container.

13. The apparatus according to claim 11 wherein one of the guide rails includes a stop surface extending above the support platform to arrest the forward motion of each mailpiece.

14. The apparatus according to claim 9 wherein each support/conveyor system includes transport and loading sections, the loading section operative to transport the mailpiece containers along the mailpiece handling path when in an in-plane position, and operative to spatially reposition each of the respective mailpiece containers such that the open end thereof is aligned with and may accept the mailpiece stack when in an out-of-plane position.

15. The apparatus according to claim 14 wherein each loading section comprises a support gate positionable from an extended position to a retracted position relative to a deck of the loading section; and wherein, in the extended position, the support gate is operative to support the mailpiece container when the loading section alternately pivots from its in-plane position to its out-of-plane position and, in the retracted position, the support gate is operative to permit unobstructed movement of the respective mailpiece container along the respective mailpiece handling path.

16. The apparatus according to claim 15 wherein each support gate comprises a pair of pin cartridges each having a retractable/extensible pin, each pin cartridge having a linear actuator for extending and retracting the pin relative to the deck of the loading section.

17. The apparatus according to claim 9 further comprising a central controller for controlling the motion of the support/conveyor system and the loading mechanism to off-load mailpieces from the respective stacking assemblies when the mailpiece containers are positioned proximal to the respective mailpiece stack.

* * * * *

UNITED STATES PATENT AND TRADEMARK OFFICE

CERTIFICATE OF CORRECTION

PATENT NO. : 7,600,751 B2
APPLICATION NO. : 11/291721
DATED : October 13, 2009
INVENTOR(S) : Boris Rozenfeld It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 804 days.

Signed and Sealed this

Fifth Day of October, 2010

David J. Kappos

David J. Kappos
*Director of the United States Patent and Trademark Office*